US005111594A

United States Patent [19]

Allen

[11] Patent Number: 5,111,594

[45] Date of Patent: May 12, 1992

[54] HAND DRIER HAVING A PLURALITY OF TRANSMITTERS AND AT LEAST ONE RECEIVER LOCATED IN THE VICINITY OF THE OUTLET

[75] Inventor: Peter W. Allen, Eynsham, United Kingdom

[73] Assignee: Airdri Limited, England

[21] Appl. No.: 669,423

[22] Filed: Mar. 15, 1991

[30] Foreign Application Priority Data

Mar. 17, 1990 [GB] United Kingdom ..... 9006068

[51] Int. Cl.[5] ..... F26B 3/34

[52] U.S. Cl. ..... 34/1 X; 392/380; 392/381; 34/202; 34/48; 34/55; 34/54

[58] Field of Search ..... 34/1, 4, 202, 44. 48, 34/55, 54, 1 R, 1 W, 1 X; 392/381, 380

[56] References Cited

U.S. PATENT DOCUMENTS

| | | | |
|---|---|---|---|
| 3,643,346 | 2/1972 | Lester | 34/48 |
| 4,087,925 | 5/1978 | Bienek | 34/202 |
| 4,914,833 | 4/1990 | Pilolla et al. | 34/202 |

FOREIGN PATENT DOCUMENTS 0229203 1/1986 European Pat. Off. .

*Primary Examiner*—Henry A. Bennet
*Assistant Examiner*—Denise L. F. Gromada
*Attorney, Agent, or Firm*—Davis, Bujold & Streck

[57] ABSTRACT

A hand drier has an air outlet at which an object for drying is presented about which are mounted a plurality of transmitters of electromagnetic radiation located in the vicinity of the outlet, the transmitters being spaced apart one from another and from at least one receiver sensitive to the radiation. The receiver is masked to prevent direct emissions from any and all of the transmitters reaching the receiver; the transmitters and the, or each, receiver are located relative to a working volume at the air outlet operate so that on an object being located in the working volume a drying cycle is initiated by the passage of emission from the transmitters being scattered by the object so as to cause at least indirect emission from the object to fall on the, or at least one, receiver. Preferably the transmitters and the or each receiver are operable with electromagnetic radiation which is at or near the infra red portion of the spectrum. The transmitters and the receiver or receivers are conveniently mounted on a common structural element such as a circuit board.

5 Claims, 3 Drawing Sheets

HAND DRIER HAVING A PLURALITY OF TRANSMITTERS AND AT LEAST ONE RECEIVER LOCATED IN THE VICINITY OF THE OUTLET

This invention relates to a drier. It relates particularly, through not exclusively, to a drier for the drying of hands, hands and face or hair which for brevity will hereinafter be referred to as a hand drier. Such driers are frequently used in a wall mounted form in cloak rooms, changing rooms, public wash places and the like.

A hand drier has to meet a number of requirements. The drying of recently washed hands and face needs to be completed in a reasonable time, say thirty seconds. This requires a substantial amount of electrical power, typically 2.5 kilowatts, and a blower capable of providing an airflow of about 150 cubic feet per minute. There is consequently a need for a mains power supply together with timing and protection devices to ensure economic and safe operation of the drier. It is known to make use of an infra-red transmitter/receiver arrangement making up part of an operational loop located in the outlet aperture of a hand drier. The transmitter periodically emits an infrared beam. The loop is completed when an object located in the path of the beam in a working volume at the outlet causes the beam to be reflected, to a greater or lesser extent, back to the receiver part of the arrangement. Thereafter a timed air heating and blowing cycle is initiated. Problems can arise with existing arrangements of this type. There is a need to ensure that on the one hand the working volume is not so large (that is to say that the transmitter range is so long) that it extends far enough from the drier outlet to result in the cycle being initiated by an object passing the heater for which no drying action is required. On the other hand there is a need to ensure that the working volume is not so small (that is to say the transmitter range is so short) that to close the loop and so initiate the cycle an object for drying has to be located so close to the outlet that it effectively blocks it.

Some objects do tend to absorb infra red emissions to the extent that any reflected signal is insufficient to trigger the receiver so as to initiate the drying cycle. Consequently despite a potential user following instructions as to the use of a hand drier the drying cycle may not be initiated.

According to the present invention there is provided a hand drier having an air outlet at which an object for drying is presented characterised by a plurality of transmitters of electromagnetic radiation located in the vicinity of the outlet, the transmitters being spaced apart one from another and from at least one receiver sensitive to the radiation, the receiver being masked from receiving direct emissions from any and all of the transmitters; the transmitters and the, or each, receiver being located relative to a working volume at the air outlet operate so that on an object being located in the working volume a drying cycle is initiated by the passage of emission from the transmitter being scattered by the object so as to cause at least indirect emission from the object to fall on the, or at least one, receiver, According to a first preferred version of the present invention the transmitters and the or each receiver is operable with electromagnetic radiation which is at or near the infra red portion of the spectrum.

According to a second preferred version of the present invention or the first preferred version thereof the transmitters and the receiver or receivers are mounted on a common structural element.

Amongst other benefits the use of a plurality of transmitters improves the overall signal to noise ratio of a signal generated by the receiver to initiate a drying cycle is higher than that generated from a single transmitter. In addition the physical separation of the transmitters enhances the probability of the, or each, receiver initiating a working cycle on the introduction of an object into the working volume which is not readily detected. This is significant since in existing systems an object having a pale and smooth reflecting surface is very likely to be detected whereas an object which is dark and absorbent (such as dark hair) may well not be detected.

An exemplary embodiment of the invention will now be described with reference to the accompanying drawings of which:

Items common to more than one figure are identified by the same reference numeral in every figure in which they appear.

Figure 1:
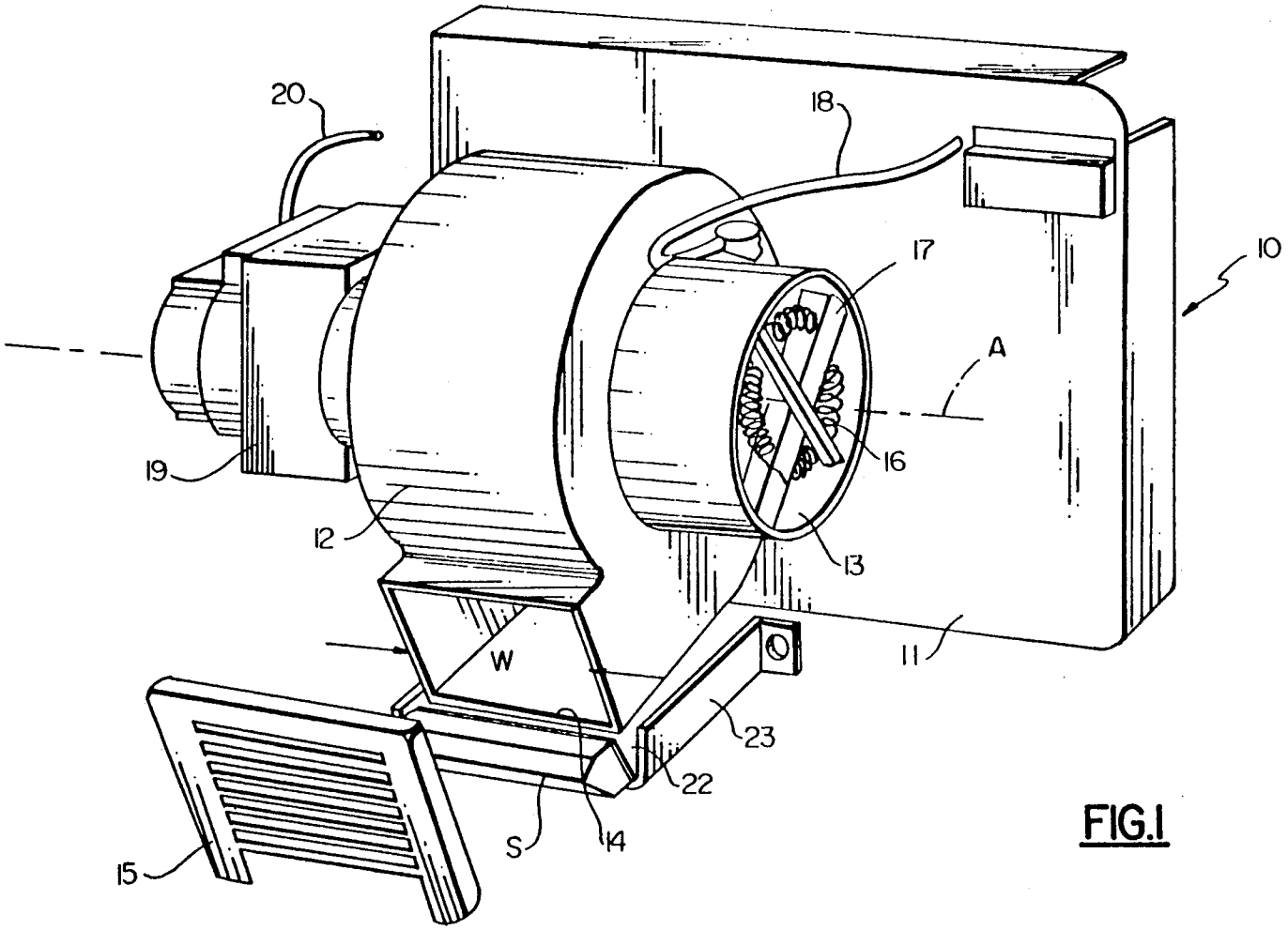
FIG. 1 is an exploded perspective view of a hand drier.
Figure 2:
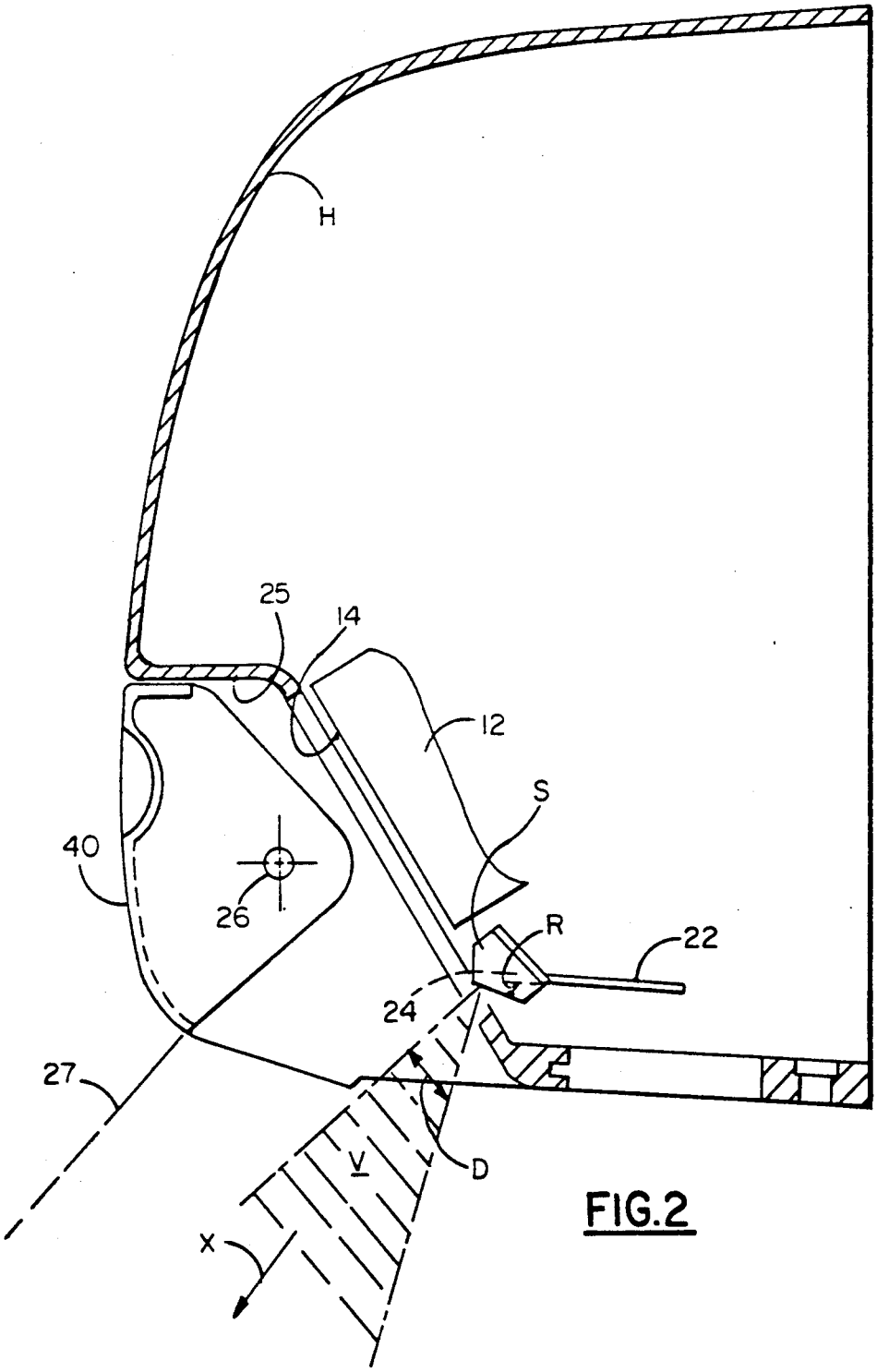
FIG. 2 is a diagrammatic cross sectional view of FIG. 1.

FIG. 1 shows the functional parts of a hand drier 10 but without its outside cover to facilitate identification of its component parts. A section of the cover is shown in FIG. 2 described hereafter. The drier is mounted on a base plate 11 by means of which the drier is secured to a wall.

The drier has an impeller enclosed within a housing 12 for rotation about axis A. The housing 12 has an axial air inlet 13 and an outlet 14 with a grille 15. The inlet 13 has a heater element 16 mounted in it on a cross-shaped former 17. The element 16 is powered by way of wire assembly 18.

The impeller is driven by an electric motor 19 powered by way of wire Loom 20.

Figure 4:
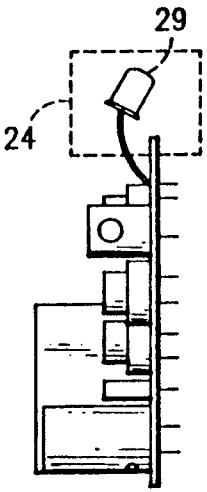
FIG. 4 is an end view of the circuit board of FIG. 3.
Figure 3:
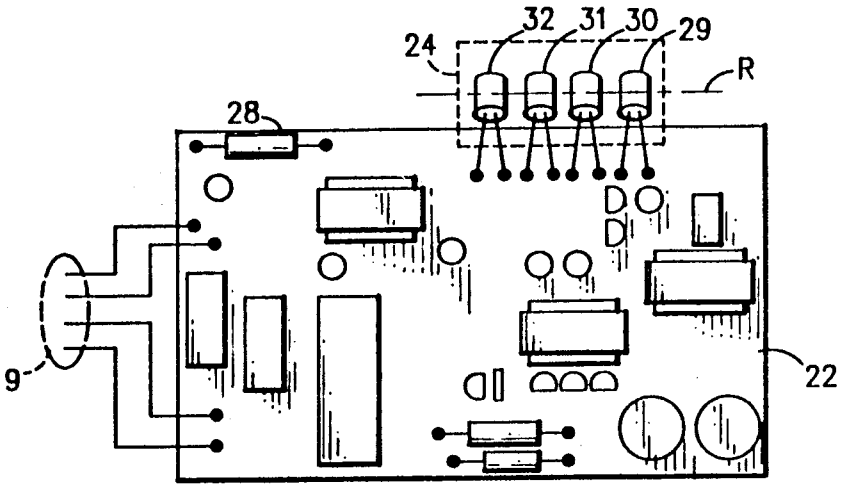
FIG. 3 is a plan view of a circuit board.
Figure 5:
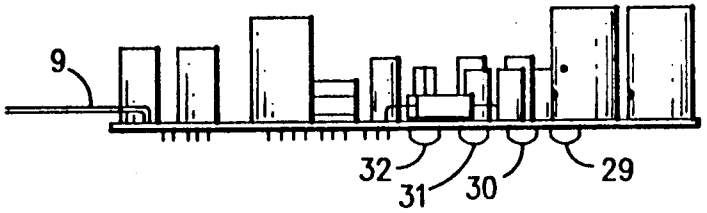
FIG. 5 is a side view of the circuit board shown in FIG. 3.

The operation of the element 16 and motor 19 is regulated by way of an autotimer 21 embodied by a circuit board 22 (shown in more detail in FIGS. 3–5) mounted with one edge in a transparent shroud S beneath the outlet 14 of the housing 12 by a structural member 23.

The circuit board 22 within shroud S incorporates an infra red assembly 24 which will be described, along with its operation hereafter with reference to FIG. 2–5. While in this case use is made of an infra red assembly a similar system of operation could be achieved making use of some other frequency radiation from the electromagnetic radiation spectrum.

FIG. 2 shows a section through housing H of the heater 10 but with most components referred to in FIG. 1 omitted for the sake of clarity. Air outlet 14 of the impeller housing 12 opens into a recess 25 formed in the housing H. The recess 25 has pivotably mounted in it for rotation about horizontal axis 26 a moveable flap 40 (shown in FIG. 2 in its uppermost position) to cause air from the air outlet 14 to be directed, in this case, downwardly. With this alignment hot air from the drier is directed downwardly so as to dry, for example hands or head placed in the volume bounded by broken lines 27.

The infra red assembly 24 is located on the outlet end 28 of the timer circuit board 22 protected by shroud S. On assembly the board is coupled to the remainder of the heater electrical system by way of a lead 9. The assembly 24 incorporates (FIGS. 3-5) a single infra red receiver 29 and three infrared transmitters 30-32 mounted in-line on a straight axis R which extends perpendicular to the plane of the paper as shown in FIG. 2. The transmitters 30-32 are spaced at least one centimeter apart from one another. The circuit board is mounted so that the assembly 24 is located just below the air outlet 14 and within width W of the outlet 14 and the bottom of the recess 25 so that infra red emissions and reflections can freely pass out of and into the assembly 24 to define a working volume V. This working volume V establishes the region into which objects for drying are introduced so as to actuate a timed drying cycle by way of the infra red assembly as will be hereafter described.

Working volume V is of wedge shape with an included angle D and a width approximately W in length into the plane of the paper. The volume V extends about 40 cms in the direction of the arrow X that is to say a distance governed by the working range of the assembly 24.

The infra red assembly 24 has the receiver 29 located at one end and the three transmitters 30-32 extending away from that end. The receiver 29 is shielded from any one of the transmitters 30-32 to the extent that so that transmissions cannot pass directly to the receiver 29 but can only be reflected back tot eh receiver 29 from objects placed in front of transmitters 30-32.

In use the transmitters 30-32 are periodically energised and emit infra red energy into working volume V. During energisation if no object is located in the volume V no infra red emission is returned to the vicinity of the receiver 29. In the event of an object being positioned within the volume V some infra red output from one or more of the transmitters 30-32 is reflected back to the receiver 29 which on detecting the reflected emission initiates a predetermined heating cycle. The length of the cycle is regulated by components on the circuit board 22 which includes elements providing for safe operation of the drier. Typically provision is made so that in the event that air cannot be freely drawn through inlet 13 because of a towel or garment placed being placed over the casing in the region of inlet 13 then the control circuitry on the board 22 act to prevent or terminate energisation of the heater element 16.

The use of a plurality of transmitters rather than a single one provides a number of benefits including a limitation to the overall length of the working volume V so that inadvertent operation does not arise when people or objects pass the drier while ensuring that even relatively dark objects placed in the working volume with a tendency to absorb infra red emissions will still be detected by way of the infra red assembly to ensure initiation of a drying cycle. The use of a plurality of transmitters ensures that the signal to noise ratio of the output of the assembly 24 is a substantial improvement over known existing systems with a single transmitter. This improvement mininizes, if not effectively eliminates, power spikes or anomalous triggering signals from causing spurious initiation of a drying cycle. This is a substantial benefit in locations where anomalous signals can be generated by systems such as security screens.

The circuitry and components used on the timer circuit board 22 are chosen to ensure any noise (used in the broadest sense of noise so as to cover spectra both inside and outside the audible range) generated by the system falls inside any national and international standards applying to such outputs.

I claim:

1. A hand drier having an air outlet at which an object for drying is presented to activate the hand drier, characterised by a plurality of transmitters of electromagnetic radiation and at least one receiver, sensitive to the radiation to be emitted by at least one of the plurality of transmitters, being located in the vicinity of the outlet, the plurality of transmitters being spaced apart one from another and from the at least one receiver, the at least one receiver being masked from receiving direct emissions from any of the plurality of transmitters; and the plurality of transmitters and the at least one receiver being located relative to a working volume at the air outlet so that, upon an object being located in the working volume, a drying cycle is initiated by the passage of emission from the transmitters being scattered by the object so as to cause at least indirect emission from the object to be reflected to the at least one receiver.

2. A hand drier as claimed in claim 1 wherein the transmitters and the at least one receiver are operable with electromagnetic radiation which is at or near the infra red portion of the spectrum.

3. A hand drier as claimed in claim 1 wherein the plurality of transmitters and the at least one receiver are mounted on a common structural element.

4. A hand drier as claimed in claim 2 herein the plurality of transmitters and the at least one receiver are mounted on a common structural element.

5. A hand drier as claimed in claim 1 wherein the plurality of transmitters comprise three infra red transmitters mounted in a line approximately 1 cm apart from one another.

* * * * *